US010219321B2

(12) United States Patent
Meyer

(10) Patent No.: US 10,219,321 B2
(45) Date of Patent: Feb. 26, 2019

(54) HEATING APPARATUS INCLUDING BATTERIES FOR STORING ELECTRICAL ENERGY

(71) Applicant: LANCEY ENERGY STORAGE S.A.S., Grenoble (FR)

(72) Inventor: Raphaël Meyer, Grenoble (FR)

(73) Assignee: LANCEY ENERGY STORAGE S.A.S., Grenoble (FR)

( * ) Notice: Subject to any disclaimer, the term of this patent is extended or adjusted under 35 U.S.C. 154(b) by 0 days.

(21) Appl. No.: 15/779,969

(22) PCT Filed: Nov. 28, 2016

(86) PCT No.: PCT/IB2016/057160

§ 371 (c)(1),
(2) Date: May 30, 2018

(87) PCT Pub. No.: WO2017/093878

PCT Pub. Date: Jun. 8, 2017

(65) Prior Publication Data

US 2018/0359813 A1 Dec. 13, 2018

(30) Foreign Application Priority Data

Nov. 30, 2015 (FR) ..... 15 61615

(51) Int. Cl.
*F24C 7/00* (2006.01)
*H05B 1/02* (2006.01)
*H05B 3/26* (2006.01)

(52) U.S. Cl.
CPC ..... *H05B 1/0277* (2013.01); *H05B 3/26* (2013.01); *H05B 2203/032* (2013.01)

(58) Field of Classification Search
None
See application file for complete search history.

(56) References Cited

U.S. PATENT DOCUMENTS 3,539,768 A * 11/1970 Eisler ..... F24D 13/024 219/213
3,619,555 A * 11/1971 Bassett, Jr. ..... B60H 1/2225 219/202

(Continued)

FOREIGN PATENT DOCUMENTS

CN 203771693 U 8/2014
DE 195 47 520 A1 6/1997

(Continued)

OTHER PUBLICATIONS

International Search Report as issued in International Patent Application No. PCT/IB2016/057160, dated Feb. 24, 2017.

(Continued)

*Primary Examiner* — Thor Campbell
(74) *Attorney, Agent, or Firm* — Pillsbury Winthrop Shaw Pittman LLP

(57) ABSTRACT

An apparatus includes a heating body and batteries. The batteries are grouped so as to form a battery bank having a parallelepiped shape which defines anterior and posterior faces of this bank. The heating body forms at least one face located along one of the anterior or posterior faces of the battery bank, or above the battery bank. The apparatus also includes a first thermal insulation plate placed between the battery bank and the heating body.

11 Claims, 3 Drawing Sheets

(56) References Cited

U.S. PATENT DOCUMENTS

| | | | | | |
|---|---|---|---|---|---|
| 4,298,789 | A * | 11/1981 | Eichelberger | H05B 3/262 | 219/391 |
| 5,616,266 | A * | 4/1997 | Cooper | F24C 7/06 | 219/407 |
| 6,080,974 | A * | 6/2000 | Ambrosiano | A47K 10/06 | 219/528 |
| 6,917,753 | B2 * | 7/2005 | Cooper | F24D 13/022 | 219/542 |
| 8,876,581 | B2 * | 11/2014 | Ulmanen | F24F 1/0007 | 454/261 |
| 2014/0038021 | A1 | 2/2014 | Goesmann et al. | | |

FOREIGN PATENT DOCUMENTS

| | | | |
|---|---|---|---|
| FR | 2 882 132 | A1 | 8/2006 |
| WO | WO 2011/089182 | A1 | 7/2011 |
| WO | WO 2012/018318 | A1 | 2/2012 |

OTHER PUBLICATIONS

The Written Opinion of the International Searching Authority as issued in International Patent Application No. PCT/IB2016/057160, dated Feb. 24, 2017.

* cited by examiner

HEATING APPARATUS INCLUDING BATTERIES FOR STORING ELECTRICAL ENERGY

CROSS-REFERENCE TO RELATED APPLICATIONS

This application is the U.S. National Stage of International Application Serial No. PCT/IB2016/057160, filed Nov. 28, 2016, which in turn claims priority to French Application No. 15/61615, filed Nov. 30, 2015. The contents of all of these applications are incorporated herein by reference in their entirety.

The present invention concerns to a heating apparatus including batteries for storing electrical energy.

It is known to associate a battery bank to a heating apparatus, this bank allowing storing some of the electrical energy used by the apparatus, in order to space the electricity consumption over time. This battery bank consequently allows taking advantage of the preferential pricing period of the electricity: the batteries are charging over the time periods during which the electricity is cheaper, typically by night, and the electricity contained in these batteries is used for the operation of the apparatus over the time periods during which the electricity is more expensive, typically by day. Such a heating apparatus comprises notably a heating body, intended to produce heat, and said battery bank. The latter is located at a distance from the heating body, being located as close as possible to an electric meter, even outside the room to be heated.

However, such an apparatus has the drawback of having a low energy efficiency, resulting from a considerable energy loss during the storage and discharge of this energy, which may be up to 30% of the content of the batteries.

In addition, the existing apparatus is generally bulky and relatively complex to install, which limits the possibilities of use.

The object of the present invention is to overcome these drawbacks by proposing a storage apparatus whose structure allows benefiting from maximum energy efficiency.

The documents FR 2 882 132 A1, WO 2011/089182 A1, CN 203771693 U, WO 2012/018318 A1 and DE 19547520 A1 describe various apparatuses according to the prior art, unable to achieve this goal.

The concerned apparatus comprises, in a manner known per se, a heating body and batteries for storing electrical energy.

According to the invention,

- the batteries are grouped so as to form a battery bank having a parallelepiped shape which defines anterior and posterior faces of this bank;
- the heating body forms at least one face located along one of said anterior or posterior faces of the battery bank, or above this battery bank, in the vicinity of this battery bank, so that the heat produced by the battery bank adds to that produced by the heating body in order to create a circulation of air around the apparatus, by convection; and
- the apparatus comprises a first thermal insulation plate placed between the battery bank and the heating body.

Thus, according to the invention, the battery bank is not separated from the heating apparatus but is, on the contrary, intimately integrated into the structure of the heating apparatus, so that it is located in the vicinity of the heating body. The expression "in the vicinity" means a distance which may be at least equal to the thickness of said first thermal insulation plate (the heating body and the battery bank therefore being respectively in contact with two opposite faces of this first thermal insulation plate), up to a distance in the range of about fifteen centimeters at most.

When the apparatus is in operation and the batteries are being recharged on the grid, that is to say, typically by day, the warm-up of these batteries due to the discharge and the recharge adds to the heat produced by the heating body, consequently increasing the heat globally emitted by the apparatus. In addition, the air circulation by convection around the battery bank allows actively dissipating the warm-up undergone by this battery bank, and therefore improves the energy efficiency of the apparatus.

When the batteries are being recharged, that is to say typically by night, the warm-up of these batteries due to the recharge adds in the same manner to the heat produced by the heating body, so that the apparatus allows a heating to a certain extent and there is also an active dissipation of the warm-up undergone by the battery bank.

In the case where the apparatus would only operate from the batteries, the warm-up of these batteries due to the discharge adds to the heat produced by the heating body, in the same manner.

Preferably, the face of the battery bank and the face of the heating body located in the vicinity of each other are planar, so as to maximize the heat exchanges of this battery bank and this heating body with each other Preferably, the apparatus comprises at least one convection plate, whose first side is in intimate contact with the anterior or posterior face formed by the battery bank, so that a heat exchange is possible between this battery bank and the convection plate.

The warm-up of the batteries due to the discharge and recharge of these batteries is transmitted to the convection plate, and therefore increases the convection effect produced by the convection plate.

The apparatus may be set on a surface or mounted on casters; it may also comprise at least one means for fastening to a wall, located on a second side of the convection plate, opposite to said first side of this convection plate, this fastening means allowing mounting the apparatus on this wall so that the convection plate is located at a distance from the ground and at a distance from said wall, so that an air flow is possible, by convection, throughout the space arranged below the apparatus and the space arranged between said convection plate and said wall.

According to a possibility, the battery bank has a shape such that its height is close to its thickness, this bank thus having the shape of an elongate block; in this case, the heating body is located above this bank; when the convection plate is present, it is in the vicinity of this convection plate.

It will be understood that the terms "height" and "thickness" are to be considered with reference to the ground on which the apparatus is set or to a wall on which the apparatus is intended to be mounted: "height" refers to the dimension of the apparatus according to a vertical direction and "thickness" refers to the dimension of the apparatus according to a direction extending from said anterior face to said posterior face. The expression "in the vicinity" is to be considered in the same manner as previously indicated.

According to another possibility, the battery bank has a shape such that its anterior and posterior faces constitute main faces and that its lateral faces individually have a reduced surface area compared to the surface area of each main face; in this case, the heating body is located along one of the anterior or posterior faces of the battery bank whereas the convection plate is located along the other of these posterior or anterior faces of this bank.

The height of the battery bank may in particular be at least five times greater than the thickness of this battery bank, the bank thus having the shape of a thick plate.

In the case of this possibility in which the anterior and posterior faces constitute main faces, the convection plate preferably extends along the posterior face of the battery bank, and said first thermal insulation plate extends along the anterior face of this battery bank; the heating body extends along said first thermal insulation plate, on the side of this plate opposite to the battery bank.

Said first thermal insulation plate may extend against the anterior face of the battery bank and the heating body may extend against this first thermal insulation plate. Alternatively, an air space is arranged between the battery bank and the heating body, said first thermal insulation plate extending either against the battery bank or against the heating body, or else the apparatus comprises a second thermal insulation plate, one of the two thermal insulation plates extending against the battery bank and the other of these two thermal insulation plates extending against the heating body.

Preferably, the apparatus comprises a thermal insulation element placed between the convection plate and each aforementioned fastening means, in order to eliminate any thermal bridge between this convection plate and this fastening means. When the fastening means consist of screws, these thermal insulation elements may in particular consist of washers made of an insulating material interposed between the convection plate and these screws.

Preferably, a junction paste is placed between the convection plate and the battery bank, in order to achieve a full connection, that is to say devoid of air spaces, between the surfaces of this convection plate and this battery bank which are in contact with each other.

Such a junction paste allows promoting the heat exchange between this bank and this plate. It may consist of a paste called "thermal paste", in particular constituted by a polymer (for example a silicone) and charged with metal particles (for example of silver), in particular used in the field of power electronics or microelectronics.

When an air space is provided between the battery bank and the heating body, and a thermal insulation plate extends against said anterior face formed by the battery bank, an identical junction paste may be placed in the same manner between this anterior face and the thermal insulation plate.

Preferably, the convection plate is perforated and/or provided with fins so as to be structured to facilitate its heat exchange with the air, and therefore to promote the creation of the air circulation by convection.

The invention will be better understood, and other features and advantages thereof will appear, with reference to the appended schematic drawing, representing, as non-limiting examples, several possible embodiments of the concerned heating apparatus.

Figure 1:
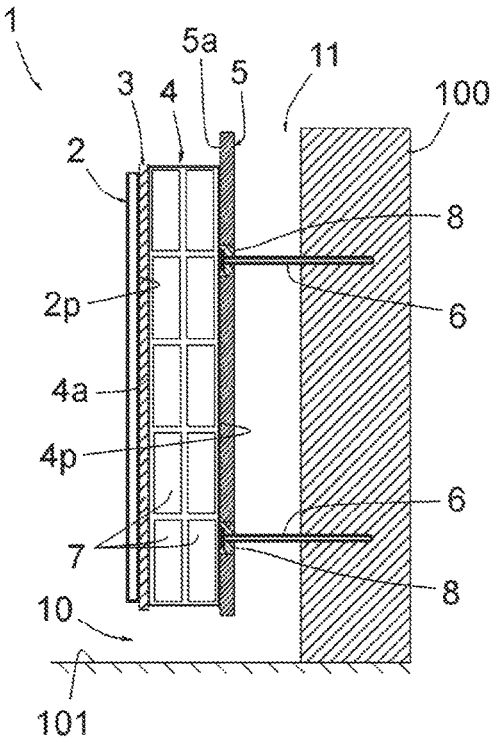
FIG. 1 is a side view of this apparatus according to a first embodiment, while it is mounted on a wall.

FIG. 1 shows a heating apparatus 1 mounted on a wall 100 such as a wall, above a floor 101.

The apparatus 1 comprises, from its anterior side (that is to say, farther from the wall 100) to its posterior side (that is to say, closer to this wall 100), a heating body 2, a thermal insulation plate 3, a battery bank 4, a convection plate 5 and screws 6 for anchoring to the wall 100.

The heating body 2 has the shape of a plate; it is constituted by a casing having planar walls made of a thermally conductive material, notably metallic, and by a resistor housed inside this casing, powered by the batteries 7 of the bank 4.

Of course, in front of this heating body 2, the apparatus 1 has a grid or an adapted guardrail, not shown, avoiding any risk of direct contact of a user with this heating body.

The plate 3 is made of a thermally insulating material, for example a common expanded material (organic or inorganic) or a thermal aerogel. It is in contact, by the entire surface of its main faces, with a planar posterior main face 2*p* formed by the casing of the heating body 2 and with a planar anterior main face 4*a* formed by the battery bank 4.

The latter has the shape of a thick plate, that is to say has a height at least five times greater than its thickness. It is constituted by a casing having planar walls made of a thermally conductive material, notably metallic, which houses a plurality of electrical energy accumulation batteries 7, such as lithium batteries. This casing forms a planar posterior main face 4*p*, by which the battery bank 4 is in intimate contact with the anterior face 5*a* of then convection plate 5, by the entire surface of this posterior face.

The convection plate 5 is constituted by a plate for example made of aluminum. It comprises a plurality of perforations receiving rings 8 made of a thermally insulating material, these rings, in turn, receiving the screws 6.

A junction paste called "thermal paste" is applied before assembly of the apparatus 1 on either one of the faces of the convection plate 5 and of the battery bank 4 intended to be in contact with each other, in order to make a full connection, that is to say, devoid of air spaces, between these faces, allowing a good thermal exchange between the bank 4 and the plate 5.

The screws 6 are inserted into the wall 100 and enable a mounting of the apparatus 1 on this wall 100 so that there is an air space 10 between the apparatus 1 and the floor 101 and an air space 11 between the wall 100 and the convection plate 5.

As example, the height of the apparatus 1 may range from 10 to 100 cm; the thickness of the battery bank 4 may range from 1 to 20 cm and each of the spaces 10, 11 may range from 3 to 10 cm.

Thus, the battery bank 4 is intimately integrated into the structure of the apparatus 1, by being in contact with the convection plate 5 and by being located in the vicinity of the heating body 2.

When the apparatus 1 is in operation and the batteries 7 are being recharged on the grid, that is to say typically by day, the warm-up of these batteries 7 due to the discharge and the recharge is communicated to the convection plate 5, and therefore increases the convection effect produced thereby. Because of the vicinity between the battery bank 4 and the heating body 2, this same warm-up adds to the heat produced by the heating body 2, consequently increasing the heat generally emitted by the apparatus 1. The circulation of the air by convection about the battery bank 4 further allows actively dissipating the warm-up undergone by this battery bank, and therefore improves the energy efficiency of the apparatus 1.

When the batteries 7 are being recharged, that is to say typically by night, the warm-up of these batteries due to recharge is transmitted in the same manner to the convection plate 5 and adds in the same manner to the heat produced by the heating body 2, so that the apparatus 1 enables a heating to a certain extent and that there is also an active dissipation of the warm-up undergone by the battery bank 4.

In the case where the apparatus 1 would only operate from the batteries 7, the warm-up of these batteries due to the discharge would be transmitted to the convection plate 5 and would add to the heat produced by the heating body 2, in the same manner.

Figure 2:
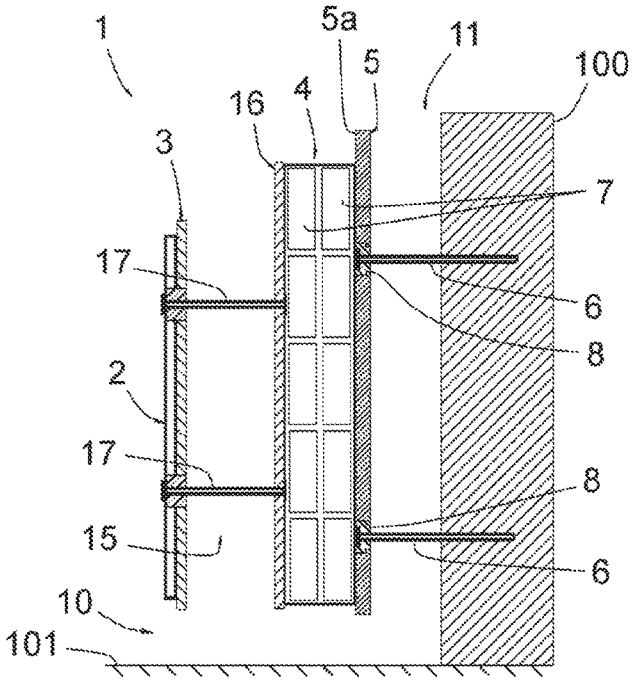
FIG. 2 is a view of the apparatus similar to FIG. 1, according to a second embodiment.

In the second embodiment of the apparatus 1 shown in FIG. 2, the heating body 2, the thermal insulation plate 3, the battery bank 4, the convection plate 5 and the screws 6 are found in an identical or very similar manner to what has just been described. For simplicity, the already described elements which are found in this second embodiment, and in the other embodiments described later on, will be assigned by the same numerical references.

In the case of this second embodiment, an air space 15 is arranged between the battery bank 4 and the heating body 2, and the apparatus 1 comprises a second thermal insulation plate 16, which extends against the anterior face 4*a* of the battery bank 4, the plate 3 extending against the heating body 2 in the same manner as before.

The mounting of the heating body 2 and the plate 3 on the casing of the battery bank 4 is achieved by means of screws 17, identically or similarly to the mounting achieved by the screws 6.

The air space 15 may have a thickness ranging from 3 to 10 cm between the faces of the plates 3 and 16 which are facing each other.

In the apparatus 1 according to this second embodiment, a double air circulation by convection is achieved throughout the spaces 10, 11 and 10, 15, on either side of the battery bank 4, thus maximizing the effect of increasing the convection and the warm-up of the air produced by the apparatus, and dissipating all the more the warm-up of the battery bank 4, therefore further improving the energy efficiency of the apparatus 1.

Figure 3:
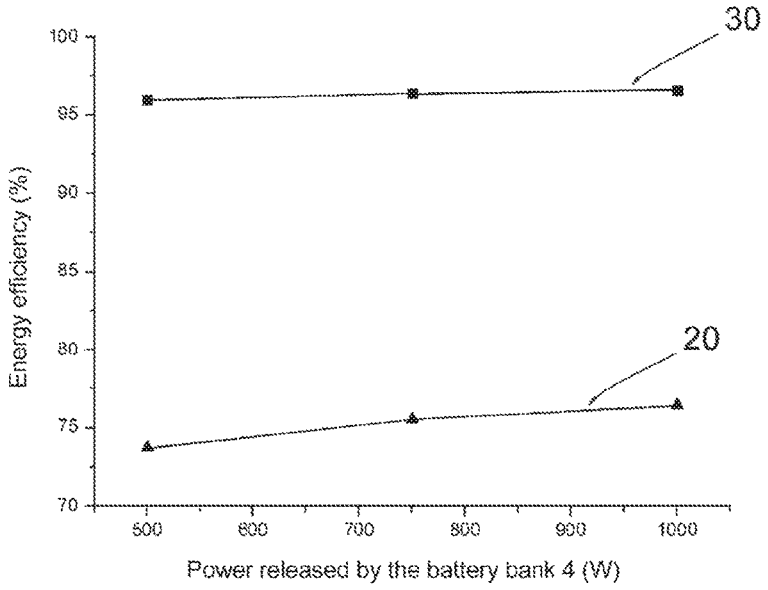
FIG. 3 shows curves comparing the performances of the apparatuses according to FIGS. 1 and 2 with those of an apparatus in accordance with the prior art.

FIG. 3 is a reference frame comprising on the abscissa axis the powers released by the battery bank 4 and on the ordinate axis the energy efficiency of the heating apparatus 1. On this reference frame, are plotted, a curve 20 relating to an apparatus according to the prior art, in which the battery bank is separated from the heating body and in which there is no convection plate, and a curve 30 relating to the apparatus 1 according to either one of the two embodiments described hereinabove.

It appears that the energy efficiency of the known apparatus peaks at about 75% whereas that of the apparatus 1 according to the present patent application exceeds 95%.

Figure 4:
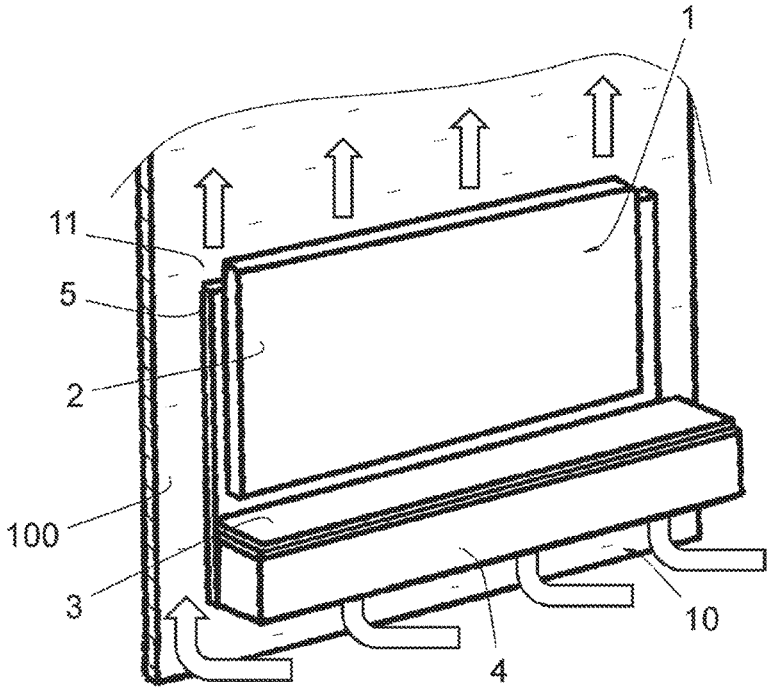
FIG. 4 is a perspective view of the apparatus according to a third embodiment.

In the case of the apparatus 1 according to the third embodiment, shown in FIG. 4, the battery bank 4 has a height close to its thickness, so that it has an elongate block shape. In this case, the heating body 2 is located above this bank 4 and in the vicinity of the convection plate 5, and the thermal insulation plate 3 is placed on the upper face of the heating body 2.

In this FIG. 4, thick arrows are further shown which represent the circulation of the air around the apparatus 1.

Figure 5:
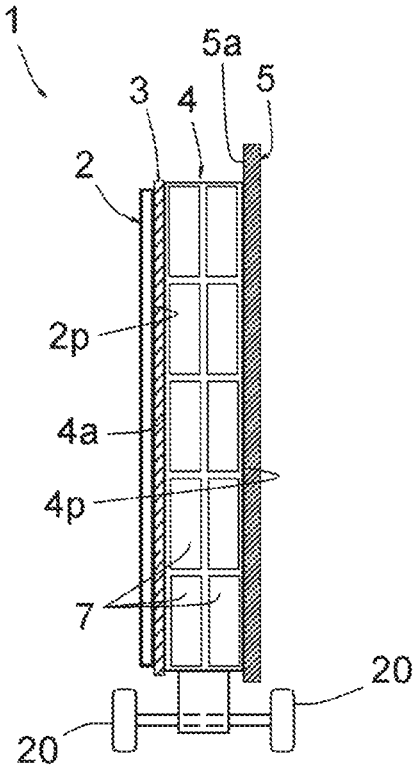
FIG. 5 is a side view of the apparatus according to a fourth embodiment, mounted on casters.

The apparatus according to the fourth embodiment shown in FIG. 5 is similar to that shown in FIG. 1, except that it is mounted on casters 20.

As it arises from the foregoing, the heating apparatus 1 according to the present invention overcomes the drawbacks of existing peer apparatuses, by providing an apparatus whose structure allows benefiting from a maximum energy efficiency.

The invention has been described hereinabove with reference to embodiments provided as examples; it is clear that it is not limited to these embodiments.

The invention claimed is:

1. A heating apparatus comprising a heating body and batteries for storing electrical energy, wherein:

the batteries are grouped so as to form a battery bank having a parallelepiped shape which defines anterior and posterior faces of the battery bank;

the heating body forms at least one face located along one of said anterior or posterior faces of the battery bank, or above the battery bank, in the vicinity of the battery bank, so that heat produced by the battery bank adds to that produced by the heating body in order to create a circulation of air around the apparatus, by convection;

the heating apparatus further comprising a first thermal insulation plate placed between the battery bank and the heating body;

at least one convection plate, whose first side is in intimate contact with the anterior or posterior face formed by the battery bank, so that a heat exchange is possible between the battery bank and the convection plate, and at least one fastening means for fastening to a wall, located on a second side of the convection plate, opposite to said first side of the convection plate, the fastening means allowing mounting the apparatus on the wall so that the convection plate is located at a distance from the ground and at a distance from said wall, so that an air flow is possible, by convection, throughout a space arranged below the apparatus and a space arranged between said convection plate and said wall.

2. The apparatus according to claim 1, wherein the face of the battery bank and the face of the heating body located in the vicinity of each other are planar.

3. The apparatus according to claim 1, wherein:

the battery bank has a shape such that a height of the battery bank is close to a thickness of the battery bank, the battery bank thus having the shape of an elongate block; and the heating body is located above the battery bank, and in the vicinity of the convection plate.

4. The apparatus according to claim 1, further comprising a thermal insulation element placed between the convection plate and each fastening means.

5. The apparatus according to claim 1, wherein a junction paste is placed between the convection plate and the battery bank, in order to achieve a full connection, devoid of air spaces, between the surfaces of the convection plate and of the battery bank which are in contact with each other.

6. The apparatus according to claim 1, wherein the convection plate is perforated and/or provided with fins.

7. The apparatus according to claim 1, wherein:

the battery bank has a shape such that its anterior and posterior faces constitute main faces and that its lateral faces individually have a reduced surface area compared to a surface area of each main face; and the heating body is located along one of the anterior or posterior faces of the battery bank whereas the convection plate is located along the other of the posterior or anterior faces of the battery bank.

8. The apparatus according to claim 7, wherein:

the convection plate extends along the posterior face of the battery bank, and said first thermal insulation plate extends along the anterior face of the battery bank;

the heating body extends along said first thermal insulation plate, on a side of the first thermal insulation plate opposite to the battery bank.

9. The apparatus according to claim 8, wherein said first thermal insulation plate extends against said anterior face of the battery bank and wherein the heating body extends against the first thermal insulation plate.

10. The apparatus according to claim 8, wherein an air space is arranged between the battery bank and the heating body, and wherein said first thermal insulation plate extends either against the battery bank or against the heating body.

11. The apparatus according to claim 8, wherein an air space is arranged between the battery bank and the heating body, and wherein the apparatus comprises a second thermal insulation plate, one of the first and second thermal insulation plates extending against the battery bank and the other of the first and second thermal insulation plates extending against the heating body.

* * * * *